US006382355B1

(12) United States Patent
Kowalewski

(10) Patent No.: US 6,382,355 B1
(45) Date of Patent: May 7, 2002

(54) CLIMBING APPLIANCE FOR ROPING-UP AND ROPING-DOWN OPERATIONS

(76) Inventor: Hubert Kowalewski, Wehe 141, D-32369, Rahden (DE)

( * ) Notice: Subject to any disclaimer, the term of this patent is extended or adjusted under 35 U.S.C. 154(b) by 0 days.

(21) Appl. No.: 09/805,563

(22) Filed: Mar. 13, 2001

(30) Foreign Application Priority Data

Mar. 13, 2000 (DE) ..... 100 11 753

(51) Int. Cl.[7] ..... A62B 27/00; A62B 1/20

(52) U.S. Cl. ..... 182/133; 182/193; 182/5; 188/65.4; 254/389

(58) Field of Search ..... 182/133, 3, 5, 182/9, 191, 193; 254/389, 390, 391, 405; 188/65.2, 65.3, 65.4

(56) References Cited

U.S. PATENT DOCUMENTS 4,580,658 A * 4/1986 Brda ..... 182/5
5,316,103 A * 5/1994 Bell et al. ..... 182/5 X
5,638,919 A * 6/1997 Pejout ..... 182/5 X
5,664,640 A * 9/1997 Smith ..... 182/5
5,927,438 A * 7/1999 Ostrobrod ..... 182/5 X
5,975,243 A * 11/1999 Lorbek ..... 182/193
6,029,777 A * 2/2000 Rogelja ..... 182/193
6,085,866 A * 7/2000 Kowalewski ..... 182/5
6,189,867 B1 * 2/2001 O'Rourke et al. ..... 254/391

* cited by examiner

*Primary Examiner*—Daniel P. Stodola
*Assistant Examiner*—Hugh B. Thompson
(74) *Attorney, Agent, or Firm*—McGlew and Tuttle, P.C.

(57) ABSTRACT

A climbing appliance (1) for roping persons up and down using the double rope technique is proposed, which comprises a housing (12) and a clamping jaw (13) mounted pivotally in the housing, wherein a main rope (2) conveyed over an upper reversing point (3) is fastened by its one end **(2*a*) to the housing (12) and is passed by its other end (2*b*) through a recess (17, 18) between housing (12) and clamping jaw (13) and is movable inside the recess (17, 18) into a clamping position and a release position. The climbing appliance further including a fastening point (21) for a connection rope (8) between the climbing appliance (1) and the person roping up or down provided off center in the outside edge region of the housing (12), that the pivot of the clamping jaw (13) is disposed substantially centrosymmetrically, and that a release rope (10) is fastened to the opposite outside edge region of the housing (12) to the fastening point (21) for the connection rope (8)**.

9 Claims, 5 Drawing Sheets

CLIMBING APPLIANCE FOR ROPING-UP AND ROPING-DOWN OPERATIONS

Figure 1:
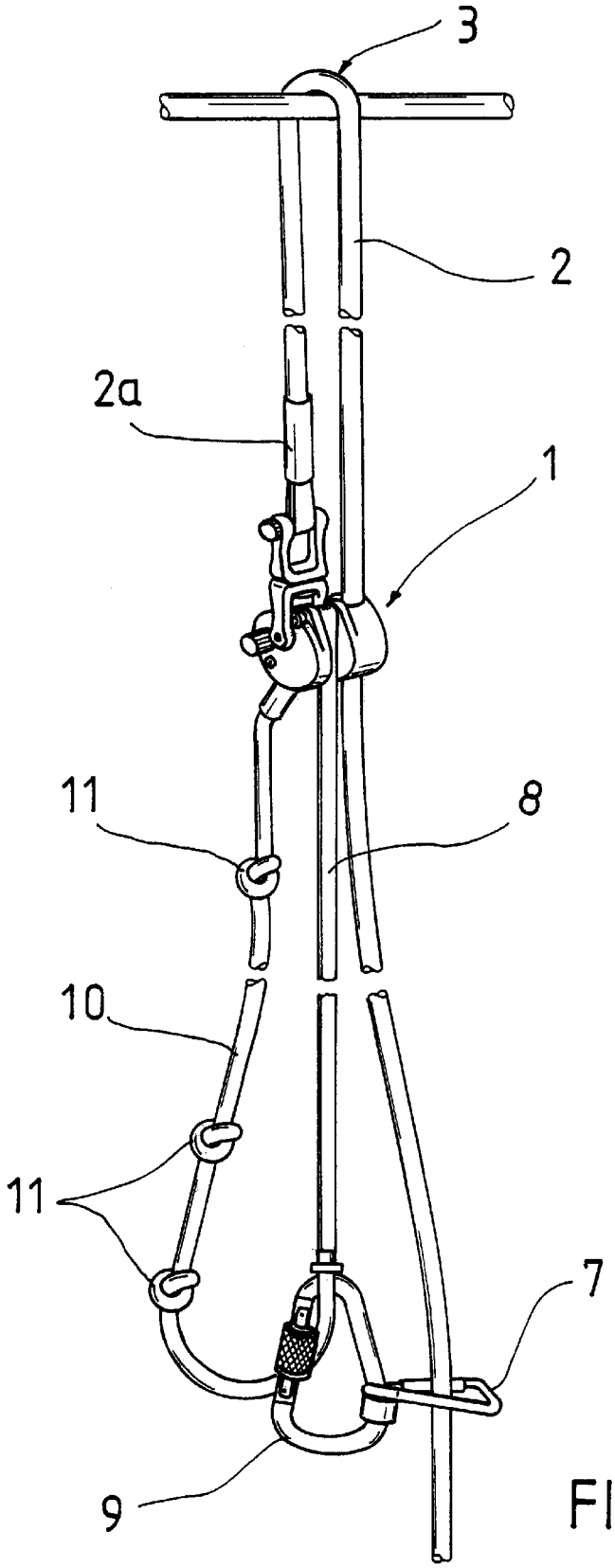

The invention relates to a climbing appliance for roping percons up and down using the double rope technique.

Climbing appliances of the described type are used in various fields, e.g. where tree surgery tasks such as treetop consolidation or lopping or work on facades or roofs has to be carried out. A further area of application is moreover in the sport of climbing for belaying purposes. The climbing appliances in said case are used, on the one hand, as a fall protection apparatus but at the same time the appliance is also to be regarded as a specialized appliance for effecting the working method, "double rope climbing technique", hereinafter referred to as "DRCT".

Utilizing the force-reducing "block-and-tackle principle", with the DRCT climbing and work is carried out using constant rope tightening, which means that each climbing movement is accompanied by a rope movement, which is actively effected by the climber.

Using said permanent rope tightening the most varied positions on a scaled article may be reliably achieved, wherein the belaying of the body to a reversing point (anchoring point) located as high up the scaled article as possible crucially stabilizes the balance of the climber. Once, for example, one of the many and widely varied working positions in tree surgery has been reached, the climbing appliance is required to be always, as after any kind of operation, automatically in a secure holding position. At any time the climber has to be able to effect a finely tuned variation of his position, either by lengthening or shortening the rope line. Without neglecting the rope tightening, a fluent moving-and-securing sequence is to be guaranteed in all planes of a scaled article. It should be emphasized that all of the described features also have to be capable of implementation one-handedly and with the body in any position relative to the appliance. DRCT, which in accordance with the apparatuses known from prior art, which without exception may be implemented by means of so-called clamping knots, about the weaknesses of which it is not intended to go into detail here, is in future to be used upwards and downwards employing the climbing appliance according to the invention and make a substantial contribution with regard to ergonomics, efficiency and safety.

Rope clampo, revolving catch appliances, roping-up appliances, roping-down appliances, arresting shock absorbers, fall arresters, rescue and self-rescue appliances with their features tuned to specific sub-regions of DRCT may be rendered redundant by the appliance according to the invention.

From DE-OS 197 46 294 A1 of the applicant a safety apparatus for roping-up and roping-down operations is known, in which the safety apparatus comprises a housing and at least one clamping jaw clampable against the housing, wherein the rope end, connected to the climber, of the main rope passed over an upper reversing point is firmly connected to the housing and the free end of the same rope, after running through the reversing point, is disposed in a clamping receiver between housing and clamping jaw. In the case of said safety apparatus, an additional belaying rope is fastened to the clamping jaw and conveyed in a receiver, which rune round radially at the outside of the housing and clamping jaw, around both components. The resultant effect is that, given tensile stress upon the belaying rope, the safety apparatus is transferred from a release position for the main rope into a clamping position for the latter. The described safety apparatus has in principle proved successful in many areas of DRCT where dynamic roping-up and roping-down operations are necessary.

A particular property of the safety apparatus is that the connection rope between climber and safety apparatus, which is known as the belaying rope and is responsible for introduction of the braking forces, ensures that, given tensile stress upon the belaying rope, a cancellation of some of the braking force is not possible even in the case of a fully executed release movement. While said feature may be employed in a perfectly positive manner, the effect of maintaining some of the braking force for roping-up may be disadvantageous in that a specific drag has to be overcome when pulling on the climbing rope.

The object of the present invention is therefore further to develop a universal climbing appliance for roping persons up and down having the generic features described initially in such a way that its area of application is extended by also enabling a cancellation of the clamping position when the connection rope between climber and climbing appliance is under tensile stress. The object of the invention is moreover to develop the climbing apparatus in such a way that it may, by virtue of a simple design, be manufactured particularly efficiently and inexpensively and maintenance and repair work on the climbing appliance may easily be carried out.

According to the technical teaching of the invention, the housing of the climbing appliance has, off centre in the outside edge region, a fastening point for a connection rope between climbing appliance and climber. Furthermore, the pivot of the clamping jaw is disposed substantially centrosymmetrically on the clamping jaw and a release rope is fastened to the housing in the opposite outside edge region to the fastening point for the connection rope.

By virtue of the special arrangement of connection rope and release rope combined with the special pivot arrangement of the clamping jaw inside the housing, given tensile stress upon the connection rope the entire climbing appliance automatically rotates. The rotation causes the rope, which extends through the recess between housing and clamping jaw, to be pressed in between housing and clamping jaw in a such a way that said rope is prevented from slipping through any further. A fall of the climber is therefore ruled out the moment the connection rope between climbing appliance and climber is subjected to tensile stress. In the present case the clamping jaw, because of its centrosymmetrical pivot, operates according to the so-called rocking lever principle, this being explained in detail in the description of the drawings below. The effect of the special arrangement of the release rope on the housing of the climbing appliance is that the rotation of the climbing appliance effected as a result of tensile stress upon the connection rope may be cancelled in an approportioned manner even though the connection rope is still under tensile stress. This facilitates operation, particularly during roping-up, because tensile stress upon the main rope fixed in the clamping apparatus, in the situation where the rope line leading to the upper reversing point of the main rope is to be shortened, also leads to rotation of the safety apparatus back into its release position for the main rope, with the result that a variation of the position of the climbing appliance on the main rope is possible even though the connection rope is still being placed under load by the climber. By virtue of the special construction according to the invention, therefore, a roping-up operation may also be effected virtually free of resistance.

In particular, it has proved expedient when the release rope fastened to the housing is accommodated in a sleeve projecting radially beyond the housing. The sleeve accommodated in the housing stiffens the end of the release rope fastened to the housing in a manner which facilitates an extended lever arm for the rotation of the climbing appliance back into the release position. Thus, the release movement may be effected without any great expenditure of force. Furthermore, by using sleeves of differing length a variation of the release resistance is possible in that the release resistance may be increased by a short sleeve or may be particularly reduced by a particularly long sleeve.

A particularly advantageous refinement of the subject matter of the invention moreover comprises the feature that the rope conveyed over the reversing point is fastened to the housing in a suspension apparatus, which is rotatable in longitudinal axis of the rope. Said suspension apparatus may according to a special construction comprise two U-shaped shackles, wherein the parallel limbs of the shackles are fastened in each case to the rope and/or to the housing and wherein the webs connecting the limbs are connected to one another by a hinge. The rotational movement possible within the rope suspension neutralizes twisting of the main rope and frictional resistances of the double rope resulting therefrom.

It has moreover proved expedient when the recess for the main rope extending through the climbing appliance is substantially a cylindrical through-bore cut half out of the housing and half out of the movable clamping law. Said construction, on the one hand, guarantees a reproducible clamping effect and, on the other hand, provides precise guidance of the supporting rope inside the safety apparatus under all operating conditions.

According to a further special refinement of the subject matter of the invention, the clamping jaw at its upper end of the through-bore directed towards the reversing point of the main rope may have a location groove, which extends substantially at right angles to the centre line of the through-bore. The width of said groove is such that it is slightly smaller than the diameter of the main rope extending through the clamping receiver. The effect achieved by said special refinement is an additional braking torque in the event of rotation of the climbing appliance as a result of tensile stress upon the connection rope. This arises from the fact that an extreme rotation of the climbing appliance, besides the clamping of the main rope between housing and clamping jaw in the through-bore, additionally effects a drawing of the main rope into the location groove provided in the clamping jaw. In said case, the special dimensional design of the groove gives rise to an additional braking effect.

It should additionally be mentioned that exchanging the clamping jaw rotatably mounted in the housing allows the use of different diameters of supporting rope in that the sub-region of the through-bore cut out of the clamping jaw is selected so as to be larger or smaller. Furthermore, easy repair of the climbing appliance may be effected by exchanging the clamping jaw, because the clamping jaw itself is to be regarded as the only essential wearing part of the entire climbing appliance.

A special further refinement variant of the invention provides that the rotational movement of the clamping jaw in the housing of the climbing appliance may be limited in terms of its maximum deflection or totally blocked by means of a setting apparatus. Said measure make it possible to effect a fine adjustment of the total braking force of the appliance.

Figure 2:
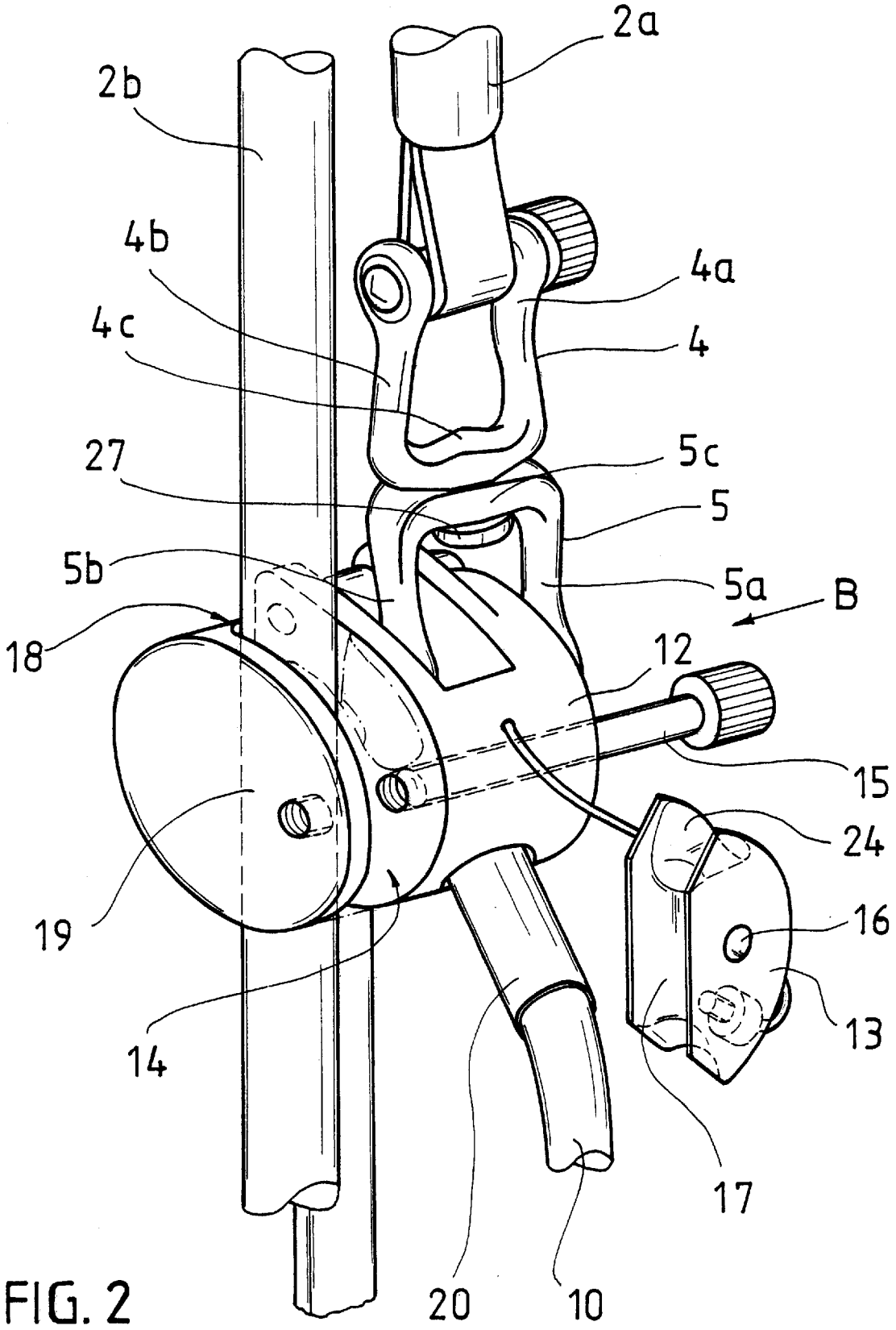
Figure 3:
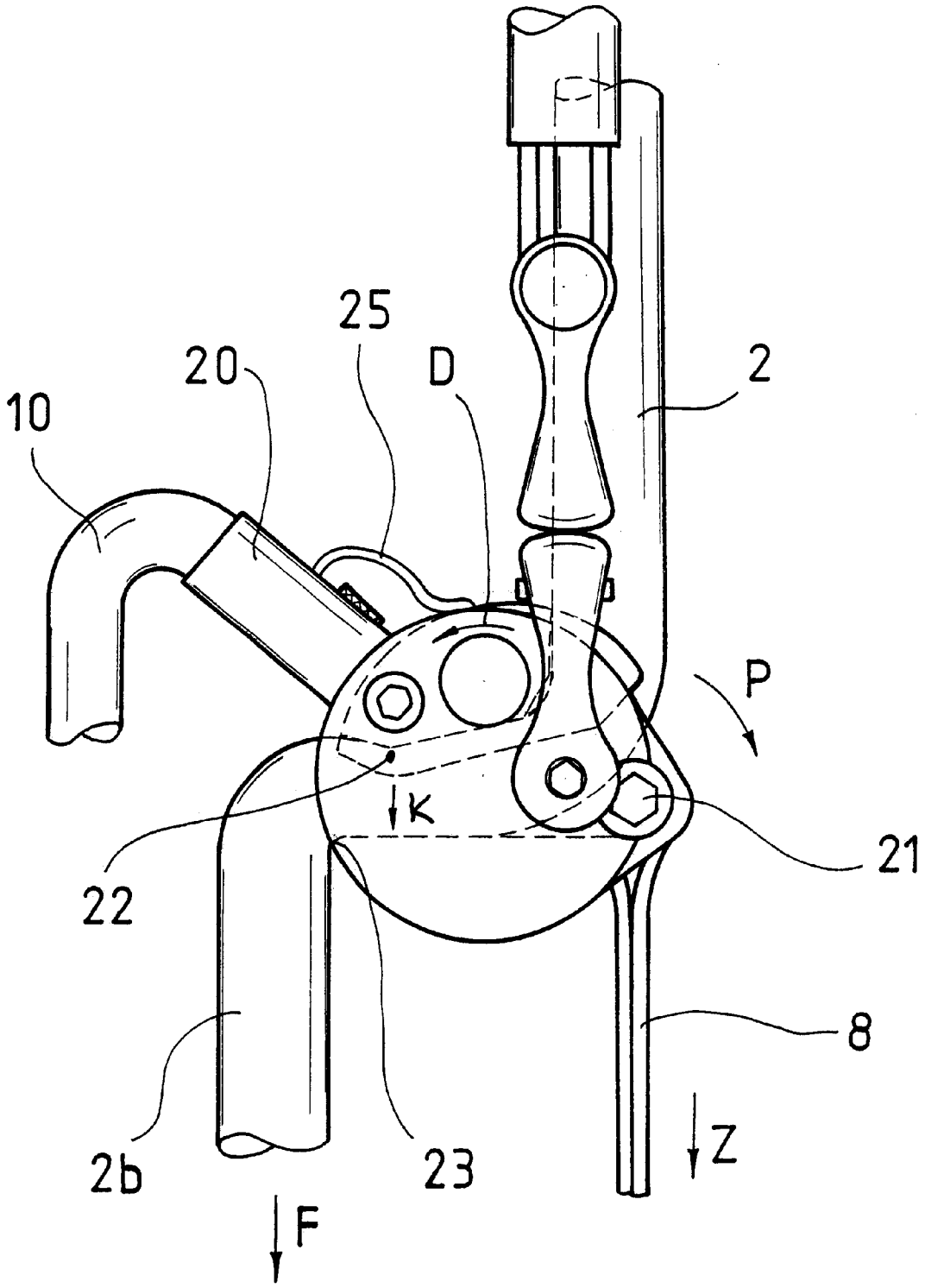
Figure 4:
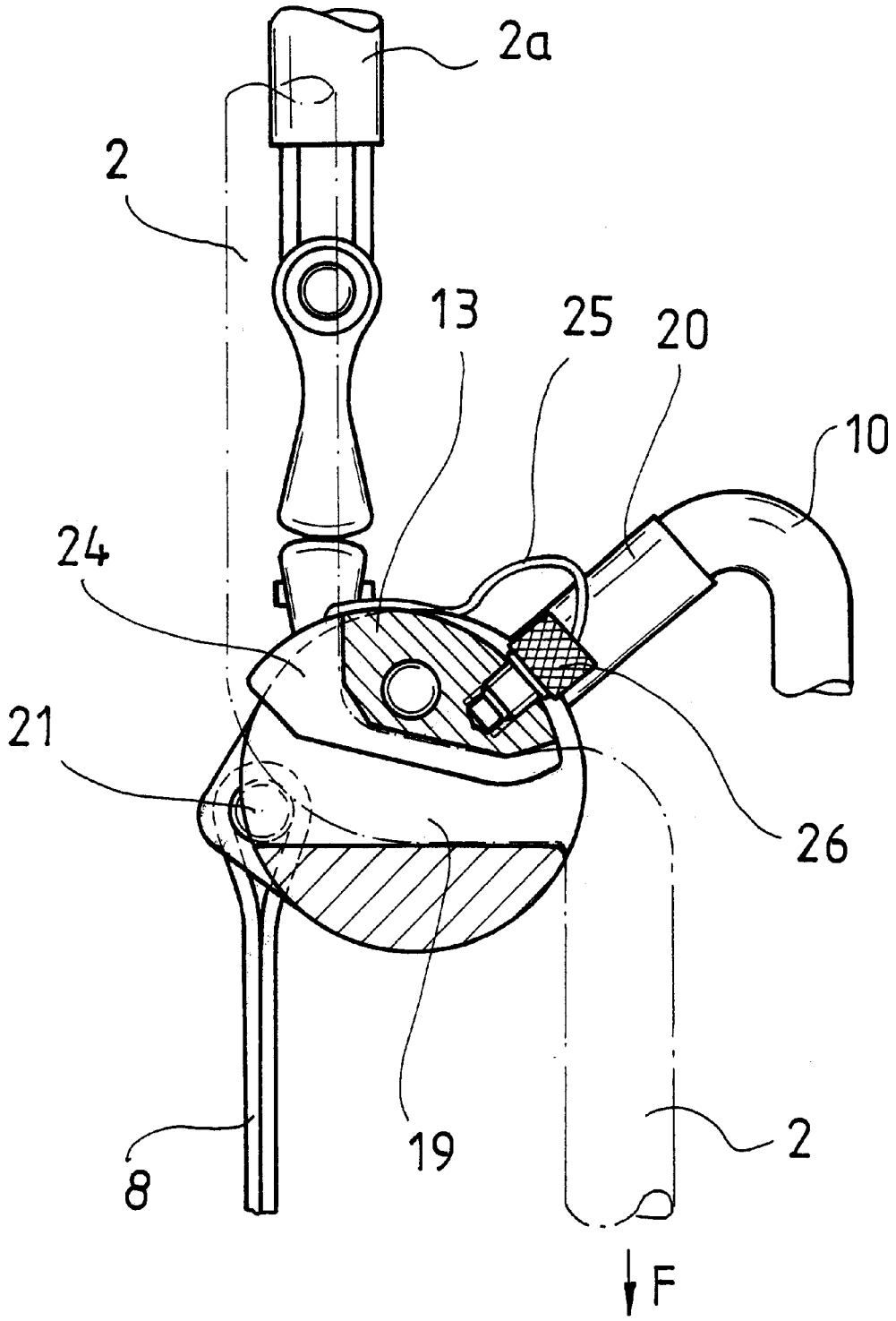
Figure 5:
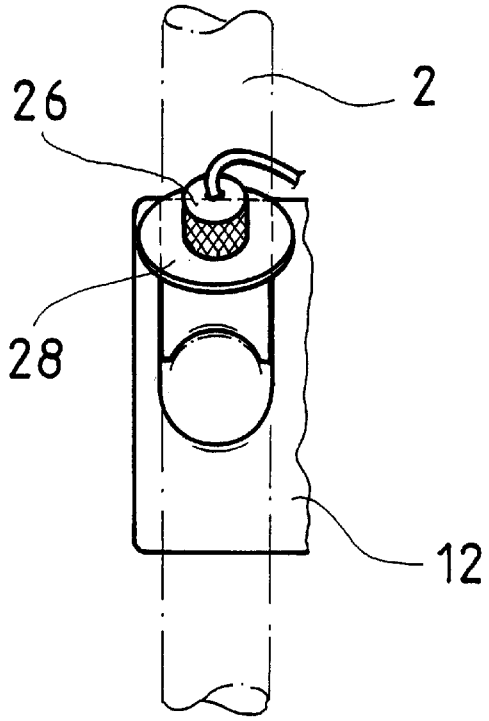
Figure 6:
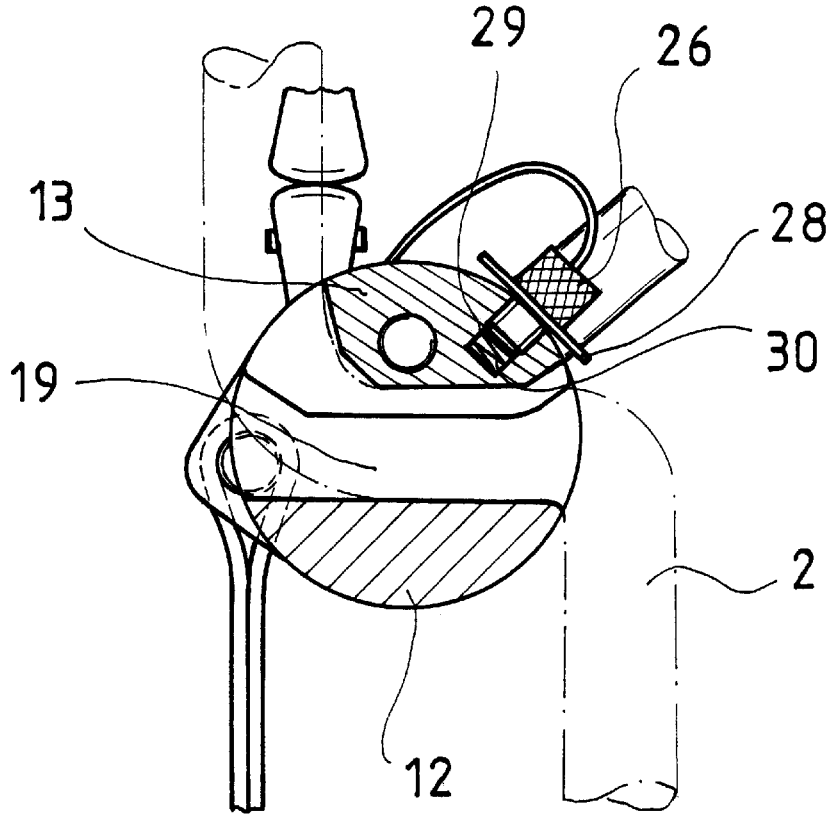

There now follows a detailed description of an embodiment of the subject matter of the invention with reference to the accompanying drawings. Said drawings show:

FIG. 1 a perspective view of the climbing appliance according to the invention given use of the double rope technique, FIG. 2 an enlarged view of the climbing appliance in the unloaded state, wherein the clamping jaw has been removed from the housing, FIG. 3 a side view of the climbing appliance in its clamping position, FIG. 4 a sectional view through the climbing appliance in the clamping position, FIG. 5 a partial view of the housing of the climbing appliance showing the setting apparatus for the clamping jaw and FIG. 6 a sectional view through the climbing appliance in the region of the adjusting device.

FIG. 1 shows the climbing appliances 1 according to the invention in conjunction with a double rope arrangement. The double rope arrangement comprises a main rope 2, which is conveyed over a reversing point 3 which, in the present embodiment, comprises a branch or the like. One of the ends 2*a* of the main rope 2 hanging down from the reversing point 3 is fastened rotatably to the climbing appliance 1 by means of a holding device comprising two U-shaped shackles 4, 5. The other free end 2*b* of the main rope 2 runs through the climbing appliance 1 in a recess 6, is subsequently passed through a rope-guiding karabiner 7 and then hangs loosely downwards. Also fastened to the climbing appliance 1 is a connection rope 8, which at its bottom free end is connected to a karabiner 9, which is intended for hooking into a loop of the climbing belt fastened around the person using the climbing appliance. For the sake of clarity, the climbing belt is not shown in detail in FIG. 1.

A further, so-called release rope 10 is moreover fastened to the climbing appliance. The release rope 10 extends likewise to the karabiner 9 and is connected there to the connection rope 8, wherein however the length of the release rope 10 is greater than the connection distance between the fastening point of the connection rope 8 to the climbing appliance 1 and its fastening point to the karabiner 9. In the present embodiment, the release rope 10 has three gripping knots 11 1or improved handling of the release rope 10.

The detailed arrangement of main rope 2, connection rope 8 and release rope 10 on the climbing appliance 1 is illustrated in detail in the following FIGS. 2 to 4.

FIG. 2 firstly illustrates once more the suspension of the rope end 2*a* by means of the shackles 4 and 5 on the climbing appliance 1. The shackles are in each case of a U-shaped design, wherein they comprise in each case two parallel limbs 4*a*, 4*b* or 5*a*, 5*b*, which are connected in each case by a connection web 4*c* or 5*c*. The connection webs 4*c* and 5*c* are connected to one another by a hinge 27 in such a way that the shackles are rotatable towards one another in the direction of the centre line of the main rope 2. Thus, the climbing appliance 1 as a whole is rotatable relative to the main rope 2, thereby enabling twisting of the main rope 2 to be neutralized and frictional resistances to be compensated.

The climbing appliance 1 substantially comprises a housing 12 and a clamping jaw 13, which is accommodated in a slot 14 of the housing 12 so as to be rotatable by means of the screw 15. The pivot 16 of the clamping jaw defined by the screw 15 lies substantially centrosymmetrically in the clamping jaw 13 so that the clamping jaw 13 may execute swivelling movements about the pivot 16 inside the slot 14 of the housing 12. Said swivelling movement is fundamental to the mode of operation of the entire climbing appliance 1, as will be explained in greater detail below.

The clamping jaw 13 at its inner lateral face, which in the installed state is accommodated in the housing, has a semi-circular location groove 17 which, together with a likewise semi-circular recess 18 disposed in the bottom region of the slot 14, in the assembled state of the climbing appliance defines a through-bore 19 for the free end 2*b* of the main rope. In the unloaded state of the climbing appliance the free end 2*b* of the main rope runs through the defined through-bore 19 without forces being exerted upon the main rope 2.

From FIG. 2 it is moreover apparent that the release rope 10 is fastened to the housing 12 of the climbing appliance 1 in a sleeve 20.

In FIG. 3 the climbing appliance 1 is shown in a side view in accordance with the arrow B of FIG. 2. From said drawing it is evident that a fastening point 21 for the connection rope 8 is situated in the opposite outside edge region of the housing 12 to the fastening point for the release rope 10 in the sleeve 20. FIG. 3 differs from the view of FIG. 2 additionally in that the housing 12 is in a position rotated through approximately 90° in the direction of the arrow P relative to its position in FIG. 2. Said position of FIG. 3 is the clamping position for the climbing appliance. The clamping position arises when, as a result of loading by the climber, a tensile force is exerted upon the connection rope 8 in the direction of the arrow Z of FIG. 3. The effect of the eccentric location of the fastening point 21 is that the tensile force in the direction of the arrow Z simultaneously leads to a rotation of the entire safety apparatus. The rotational movement of the safety apparatus in turn leads to a tilting of the rope end 2*b* of the main rope 2 running through the safety apparatus. Tilting of the main rope 2 exerts forces upon the clamping jaw 13 rotatably mounted inside the climbing appliance, the effect of which forces is that the clamping jaw 13 is rotated in the direction of the arrow D. The centrosymmetrical arrangement of the pivot combined with the loading of the clamping jaw by the deflected main rope 2 clearly gives rise to a so-called rocking lever effect, which leads at the pressure point 22 to a clamping effect in the direction of the arrow K upon the main rope 2. Said clamping effect is assisted by the fact the main rope 2 at its outlet from the climbing appliance is again sharply deflected and additional pressing forces are exerted via the edge 23 upon the main rope. Furthermore, the clamping effect upon the main rope 2 inside the climbing appliance 1 is additionally increased by the fact that the clamping jaw 13, as is evident from FIG. 2, at its upper end of the through-bore 19 directed towards the reversing point 3 of the main rope 2 has a location groove 24, which extends substantially at right angles to the centre line of the through-bore 19 and the width of which is slightly smaller than the diameter of the main rope 2 extending through the through-bore 19. The rotation of the climbing appliance and the consequent tilting of the main rope 2 result in the main rope 2 being pressed into the location groove 24, so that by said means an additional clanging effect is achieved.

The cooperation of the rotational movement of the climbing appliance 1 as a result of tensile loading of the connection rope 8 with the rocking lever principle of the clamping jaw 13 and the resulting build-up of various clamping effects inside the safety apparatuses is further evident from the sectional view of FIG. 4. The reference characters of said FIG. 4 correspond to the reference characters already used in FIG. 3, wherein the view of FIG. 4 shows the climbing appliance from the opposite side to the view of FIG. 3. It is again apparent that the rotation of the climbing appliance 1 leads to a deflection of the main rope 2 inside the through-bore 19, which is defined by the recess 18 in the housing and by the location groove 17 in the clamping jaw. FIG. 4 moreover clearly shows the position of the location groove 24, into which the main rope 2 is pressed in the clamping position of the climbing appliance 1.

When the clamping effect of the climbing appliance 1 is to be cancelled, two different possibilities exist for said purpose.

Firstly, by pulling on the release rope 10 the rotation of the climbing appliance 1 may be undone, thereby restoring the release position rotated through 90° of FIG. 1, in which the main rope 2 may run freely through the through-bore 19 of the climbing appliance. There is moreover the possibility of likewise undoing the rotation of the climbing appliance 1 into the clamping position through tensile loading of the main rope 2 in the direction of the arrow F, which, as was described initially, offers particular advantages during roping-up of the person using the climbing appliance.

The special arrangement of the pivot of the clamping jaw 13 combined with the fastening points for the release rope 10 and the connection rope 8 at opposite points of the outside edge region of the housing 12 leads in a particularly advantageous manner to a ready response of the safety apparatus upon operation of the release rope 10 or the main rope 2 and guarantees a stable position without tilting-away of the climbing appliance 1 on the supporting rope 2. Furthermore, various rope diameters may be used for the supporting rope 2 and the response characteristic upon operation of the release rope 10 may be adjusted by using sleeves 20 of differing length since the length of the sleeve 20 varies the lever arm for operation of the release rope.

It is moreover easily possible by exchanging the clamping jaw 13, as the only fundamental "wearing part" of the entire climbing appliance 1, to keep the cost of repair within low limits, wherein the different configuration of the location groove 17, which co-defines the through-bore 19, allows differing use of various types of rope. From FIGS. 2 to 4 it is evident that, to facilitate assembly and/or as a protection against loss, the clamping jaw is secured by means of a connection cord 25 and a knurled screw 26.

In conjunction with the knurled screw 26 provided as a protection against loss it is moreover possible, according to a special further refinement variant of the invention, for the rotational movement of the clamping jaw in the housing of the climbing appliance to be limited in terms of its maximum deflection or totally blocked by means of a setting apparatus, wherein said measure makes it possible to effect fine adjustment of the total braking force of the appliance.

The setting apparatus comprises the plain washer 28, which is shown in FIG. 5 and which is wider than the width of the clamping jaw 13 so that the projecting edges of the washer 28 are supported against the shoulders of the housing 12, which are situated adjacent to the slot 14 for the clamping jaw 13.

As a further element of the setting device, a compression spring 29 situated in the closed tapped bore 30 for the knurled screw may be seen in FIG. 6. The compression spring serves as a locking element for the knurled screw 26. When the latter is screwed fully into the closed tapped bore 30, the plain washer 28 is fixed in axial direction of the knurled screw and by virtue of its simultaneous application against the housing blocks the swivelling movement of the clamping jaw 13 about its pivot defined by the screw 15. The clamping effect of the clamping jaw 13 as a result of the rocking lever effect is therefore cancelled. When the knurled screw is unscrewed to a greater or lesser extent from the closed tapped bore play arises between washer 28 and housing 12 so that the clamping jaw 13 may execute movements within an adjustable swivelling range and consequently build up clamping forces. Thus, through the adjustment of the knurled screw 26 in conjunction with the washer 28 easy setting of the total braking force of the climbing appliance 1 is provided.

Finally, it should further be noted that the appliance according to the invention may, by omitting the release rope and adapting the geometries of through-bore 19 and location groove 24 for the main rope, easily be converted into a self-rescue appliance for permanent slow roping-down. In said case also, the rate of descent may be varied with the aid of the setting apparatus for the swivelling movement of the clamping jaw 13.

List of reference characters

| | |
|---|---|
| 1 | climbing appliance |
| 2 | main rope |
| 2a | rope end |
| 2b | rope end |
| 3 | reversing point |
| 4 | shackle |
| 4a | limb |
| 4b | limb |
| 4c | limb |
| 5 | shackle |
| 5a | limb |
| 5b | limb |
| 5c | connection web |
| 6 | recess |
| 7 | rope-guiding karabiner |
| 8 | connection rope |
| 9 | karabiner |
| 10 | release rope |
| 11 | gripping knots |
| 12 | housing |
| 13 | clamping jaw |
| 14 | slot |
| 15 | screw |
| 16 | pivot |
| 17 | location groove |
| 18 | recess |
| 19 | through-bore |
| 20 | sleeve |
| 21 | fastening point |
| 22 | pressure point |
| 23 | edge |
| 24 | location groove |
| 25 | connection cord |
| 26 | knurled screw |
| 27 | hinge |
| 28 | washer |
| 29 | compression spring |
| 30 | closed tapped bore |

What is claimed is:

1. A climbing appliance for roping a person up and down using a double rope technique, the climbing appliance comprising: a housing; a clamping jaw mounted pivotally in the housing; a main rope conveyed over an upper reversing point with one end of the rope fastened to the housing, the rope having another end passing through a recess between the housing and the clamping jaw and the rope being movable inside the recess into a clamping position and into a release position; a fastening point for a connection rope, said fastening point being provided between the climbing appliance and the person roping up off center in an outside edge region of the housing, the pivot axis of the clamping jaw being disposed substantially centrosymmetrically; and a release rope fastened to an outside edge region of the housing, the outside edge region of the housing being opposite to the fastening point for the connection rope.

2. The climbing appliance according to claim 1, wherein the release rope fastened to the housing is accommodated in a sleeve, the sleeve projecting radially beyond the housing.

3. The climbing appliance according to claim 2, wherein the main rope conveyed over the reversing point is fastened to the housing in a suspension apparatus, which is rotatable about a longitudinal axis of the main rope.

4. The climbing appliance according to claim 1, wherein the main rope is conveyed over the reversing point and is fastened to the housing via a suspension apparatus which is rotatable about a longitudinal axis of the main rope.

5. The climbing appliance according to claim 4, wherein the suspension apparatus comprises two U-shaped shackles, wherein parallel limbs of the shackles are respectively fastened to the main rope and to the housing and webs connecting the limbs are connected to one another by a hinge.

6. The climbing appliance according to claim 1, wherein the recess for the main rope extending through the climbing appliance is substantially a cylindrical through-bore cut half out of the housing and half out of the clamping jaw.

7. The climbing appliance according to claim 6, wherein the clamping jaw at its upper end of the through-bore directed towards the reversing point of the main rope has a location groove, which extends substantially at right angles to the center line of the through-bore and the width of the location groove is slightly smaller than the diameter of the main rope (2) extending through the through-bore.

8. The climbing appliance according to claim 1, wherein the rotational movement of the clamping jaw in the housing may be limited in terms of its maximum deflection by means of a setting apparatus.

9. The climbing appliance according to claim 8, wherein the rotational movement of the clamping jaw in the housing may be blocked by means of a setting apparatus.

* * * * *